US005943870A

United States Patent [19]

Lee

[11] Patent Number: 5,943,870

[45] Date of Patent: Aug. 31, 1999

[54] REFRIGERATOR HAVING AN APPARATUS FOR CONTROLLING COOLING INTENSITY WITH ONE FAN

[75] Inventor: Yong-Keon Lee, Incheon, Rep. of Korea

[73] Assignee: Daewoo Electronics Co., Ltd., Seoul, Rep. of Korea

[21] Appl. No.: 08/870,445

[22] Filed: Jun. 6, 1997

[30] Foreign Application Priority Data

Sep. 25, 1996 [KR] Rep. of Korea ..... 96-42578

[51] Int. Cl.[6] ..... F25D 17/04; F24F 7/00

[52] U.S. Cl. ..... 62/187; 62/413

[58] Field of Search ..... 62/186, 187, 413, 62/408; 236/49.3; 454/186

[56] References Cited

U.S. PATENT DOCUMENTS 4,320,628 3/1982 Okajima ..... 62/332 X 5,357,765 10/1994 Thomas et al. ..... 62/187

FOREIGN PATENT DOCUMENTS 2143015 1/1985 United Kingdom ..... 62/187

*Primary Examiner*—William Wayner

*Attorney, Agent, or Firm*—Smith, Gambrell & Russell; Beveridge, DeGrandi, Weilacher & Young, Intellectual Property Group

[57] ABSTRACT

A refrigerator having an apparatus for controlling cooling intensity with one fan is disclosed. The refrigerator has ducts for supplying a freezing compartment and a fresh food compartment with cool air from a cooler, and one fan for blowing the cool air into the ducts. The ducts are selectively closed by a plate which pivots by a motor. Since the fresh food compartment is frequently used more than the freezing compartment, the plate is controlled to keep the fresh food compartment in a normal open state so as to supply the fresh food compartment with much more cool air. Thus, the distribution of the cool air in the freezing compartment and the fresh food compartment is effectively carried out.

2 Claims, 4 Drawing Sheets

REFRIGERATOR HAVING AN APPARATUS FOR CONTROLLING COOLING INTENSITY WITH ONE FAN

BACKGROUND OF THE INVENTION

1. Field of the Invention

The present invention relates to a refrigerator having an apparatus for controlling cooling intensity with one fan, and more particularly to a refrigerator having one fan for blowing cool air and a plate for selectively supplying a freezing compartment and a fresh food compartment with the cool air blown by the fan.

2. Prior Art

FIG. 1 is a side sectional view of a conventional refrigerator. The refrigerator has a body 10 forming a freezing compartment 21 and a fresh food compartment 22 which are partitioned from each other by a wall 27, and a freezing compartment door 24 and a fresh food compartment door 25 which open/close the freezing compartment 21 and fresh food compartment 22 respectively.

A compressor 23 is installed in a lower rear part of the body 10, and a cooler 29 for generating cool air by evaporating refrigerant supplied from the compressor 23 is installed in the rear of the freezing compartment 21. Blowing fans 19 for blowing the cool air generated by the cooler 29 are installed at the upper side of the evaporator 29 so as to supply the freezing compartment 21 and the fresh food compartment 22 with the cool air. The blowing fans 19 consist of a freezing compartment fan 19*a* for blowing the cool air into the freezing compartment 21 and a fresh food compartment fan 19*b* for blowing the cool air into the fresh food compartment 22.

A plurality of cool air ports 16, 18 are formed respectively at the rear walls of the freezing compartment 21 and the fresh food compartment 22. When the door 25 is closed, the cool air from the cooler 29 is blown by the blowing fans 19 so as to be supplied into the freezing compartment 21 and the fresh food compartment 22, and accordingly the foodstuffs stored in the freezing compartment 21 and the fresh food compartment 22 are frozen and refrigerated.

However, in such a conventional refrigerator, there is a problem that two blowing fans 19*a*, 19*b* should be adopted for blowing the cool air respectively into the freezing compartment 21 and the fresh food compartment 22, and the blowing fans 19*a*, 19*b* should be controlled independently of each other according to the corresponding temperatures to the cooling intensities of the freezing compartment 21 and the fresh food compartment 22 which are set by a user.

SUMMARY OF THE INVENTION

The present invention has been proposed to overcome the above described problems in the prior art, and accordingly it is an object of the present invention to provide a refrigerator which is possible to supply the cool air into the freezing compartment and the fresh food compartment by only one fan, and to properly maintain the temperatures of the freezing compartment and the fresh food compartment with the corresponding temperatures according to the cooling intensities set by a user.

To achieve the above object, the present invention provides a refrigerator having a body forming a freezing compartment and a fresh food compartment partitioned from each other, and a cooler for generating cool air supplied into said freezing compartment and said fresh food compartment, said refrigerator comprising: a freezing compartment duct communicating said cooler with said freezing compartment; a fresh food compartment duct for communicating said cooler with said freezing compartment; a fan for blowing the cool air generated from said cooler into said freezing compartment duct and said fresh food compartment duct; a plate being pivotably installed on an area adjacent to suction ports of said freezing compartment duct and said fresh food compartment duct which are opened near said cooler, said plate for opening/closing the suction ports according to pivoting positions thereof; a motor for driving said plate; and a control part for controlling said driving motor.

It is preferable that the fresh food compartment duct is kept in normal open state for the effective distribution of the cool air, and for this, it is preferable that the control part comprises first and second temperature sensors for sensing temperatures in the freezing compartment and the fresh food compartment respectively; first and second comparators for comparing output voltages of the first and second temperature sensors respectively with voltages corresponding to set cooling intensities of the freezing compartment and the fresh food compartment, wherein the comparators output logic signals corresponding to results of comparisons respectively; a logic gate for performing logic operation of outputs of the first and second comparators; and a motor control circuit part for driving the driving motor in forward and reverse directions according to the outputs of the logic gate.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the drawings.

Figure 1:
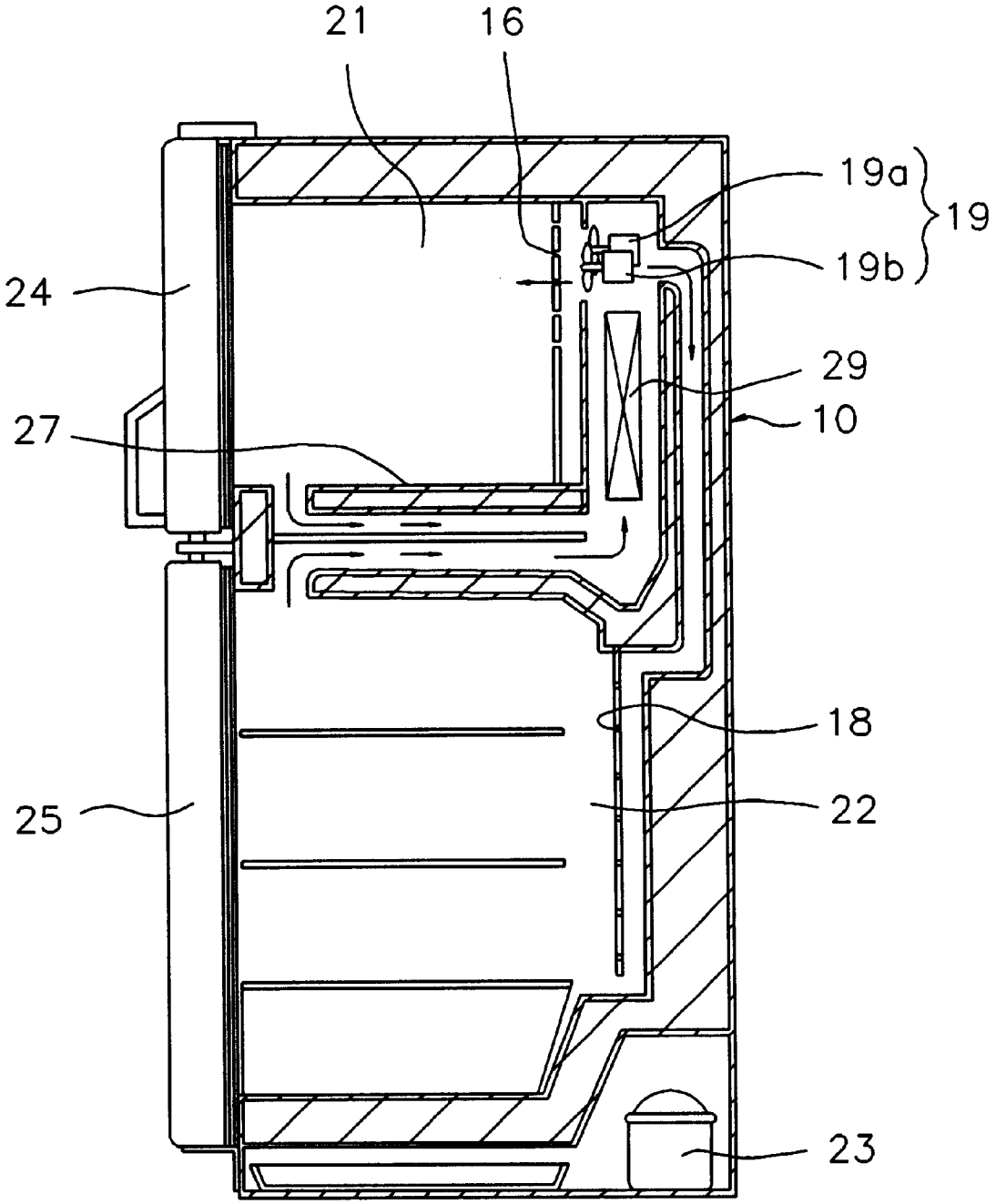
FIG. 1 PRIOR ART
FIG. 1 is a side sectional view of a conventional refrigerator.
Figure 2:
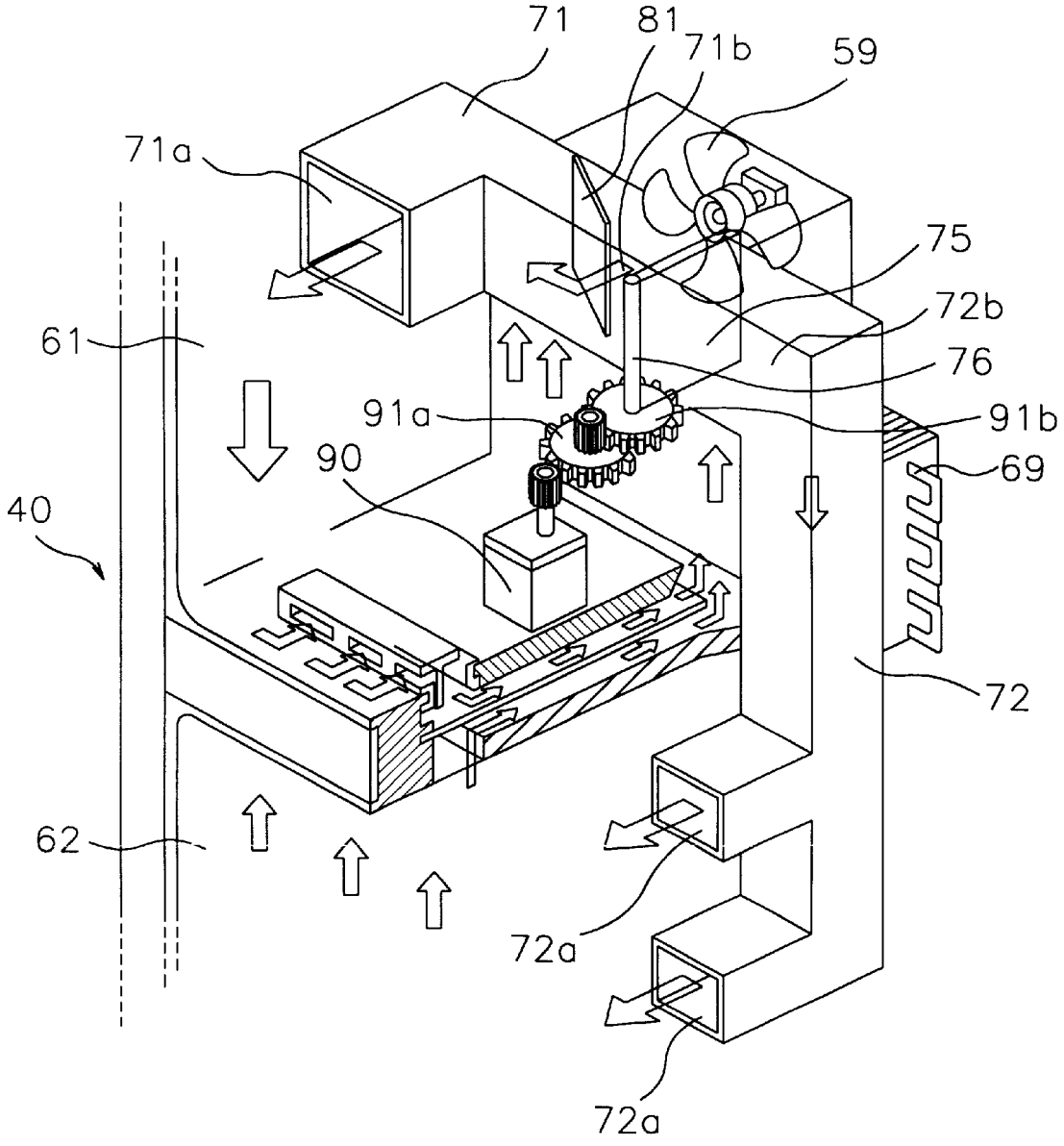
FIG. 2 a partial perspective view of a refrigerator according to the present invention.
Figure 3:
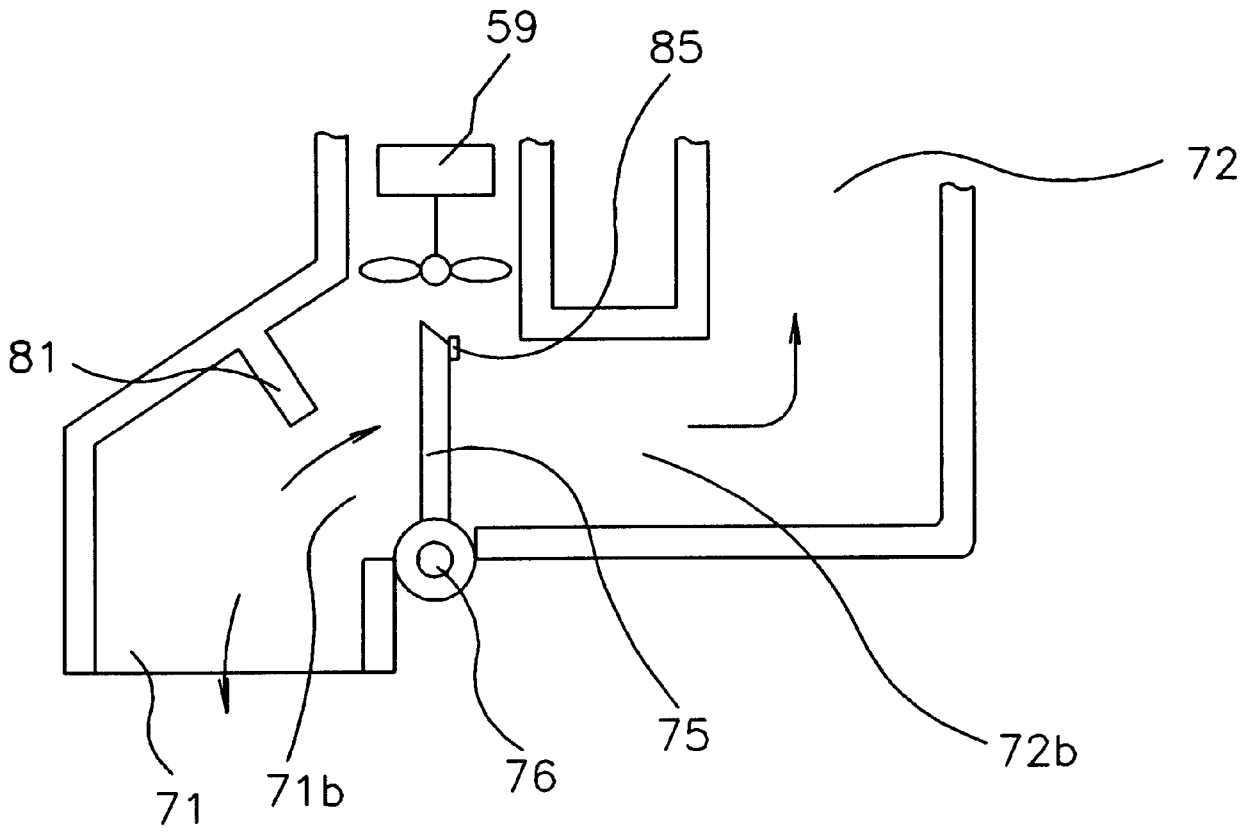
FIG. 3 is a partial transverse sectional view of the refrigerator in FIG. 2.

FIG. 2 a partial perspective view of a refrigerator according to the present invention, and FIG. 3 is a partial transverse sectional view of the refrigerator in FIG. 2. A freezing compartment 61 is formed in the upper part of the body 40 of the refrigerator and a fresh food compartment 62 is formed in the lower part of the body 40 of the refrigerator. A cooler 69 for generating cool air is installed in the rear part of the refrigerator.

The freezing compartment 61 is connected with the cooler 69 by the freezing compartment duct 71, and the fresh food compartment 62 is connected with the cooler 69 by the fresh food compartment duct 72. The suction ports 71*b*, 72*b* of the freezing compartment duct 71 and the fresh food compartment duct 72 are opened at the area adjacent to the cooler 69, and the discharging ports 71*a*, 72*a* are opened in the freezing compartment 61 and the fresh food compartment 62. A blowing fan 59 is disposed between the suction ports 71*b*, 72*b* of the ducts 71, 72 and the cooler 69. The blowing fan 59 blows the cool air generated by the cooler 69 to supply the cool air into the ducts 71, 72.

The suction ports 71*b*, 72*b* are opened and closed by a plate 75. The plate 75 is pivotably installed at the area adjacent to the suction ports 71*b*, 72*b* with being centered by a rotating shaft 76, and selectively opens/closes the ducts 71, 72 according to the pivoting position. When the freezing compartment duct 71 is opened and the fresh food compartment duct 72 is closed by the plate 75, the cool air from the cooler 69 is supplied into the freezing compartment 61, and when the fresh food compartment duct 72 is opened and the freezing compartment duct 71 is closed by the plate 75, the cool air from the cooler 69 is supplied into the fresh food compartment 62.

The pivoting range of the plate 75 is defined by a supporting plate 81 formed near the suction port 71*b* of the freezing compartment 71 and a protrusion 85 formed near the suction port 72*b* of the fresh food compartment duct 72. During the state when the plate 75 pivots to be in contact with the supporting plate 81, the freezing compartment duct 71 is closed, and during the state when the plate 75 pivots to be in contact with the protrusion 85, the fresh food compartment duct 72 is closed. During that situation, the protrusion 85 is formed not in the position that the suction port 72*b* of the fresh food compartment 72 is perfectly closed but in the position which restricts the suction port 72*b* to be opened at a predetermined degree as shown in FIG. 3. Thus, more than a specific amount of the cool air is supplied into the fresh food compartment 61 during the operation of the cooler 69 and the blowing fan 59, and accordingly the cooling intensity of the fresh food compartment 62 which requires much more cooling operation than the freezing compartment 61 can be maintained properly. It is possible that the protrusion 85 is formed in a position in which the fresh food compartment 72 is completely closed. The air flow in the two compartments is shown by directional arrows.

Gears 91*a*, 91*b* and a driving motor 90 are installed under the plate 75. The power of the driving motor 90 is transmitted to the rotating shaft 76 of the plate 75 while being reduced in rotational velocity by the gears 91*a*, 91*b*, and accordingly the plate 75 is driven to rotate.

Figure 4:
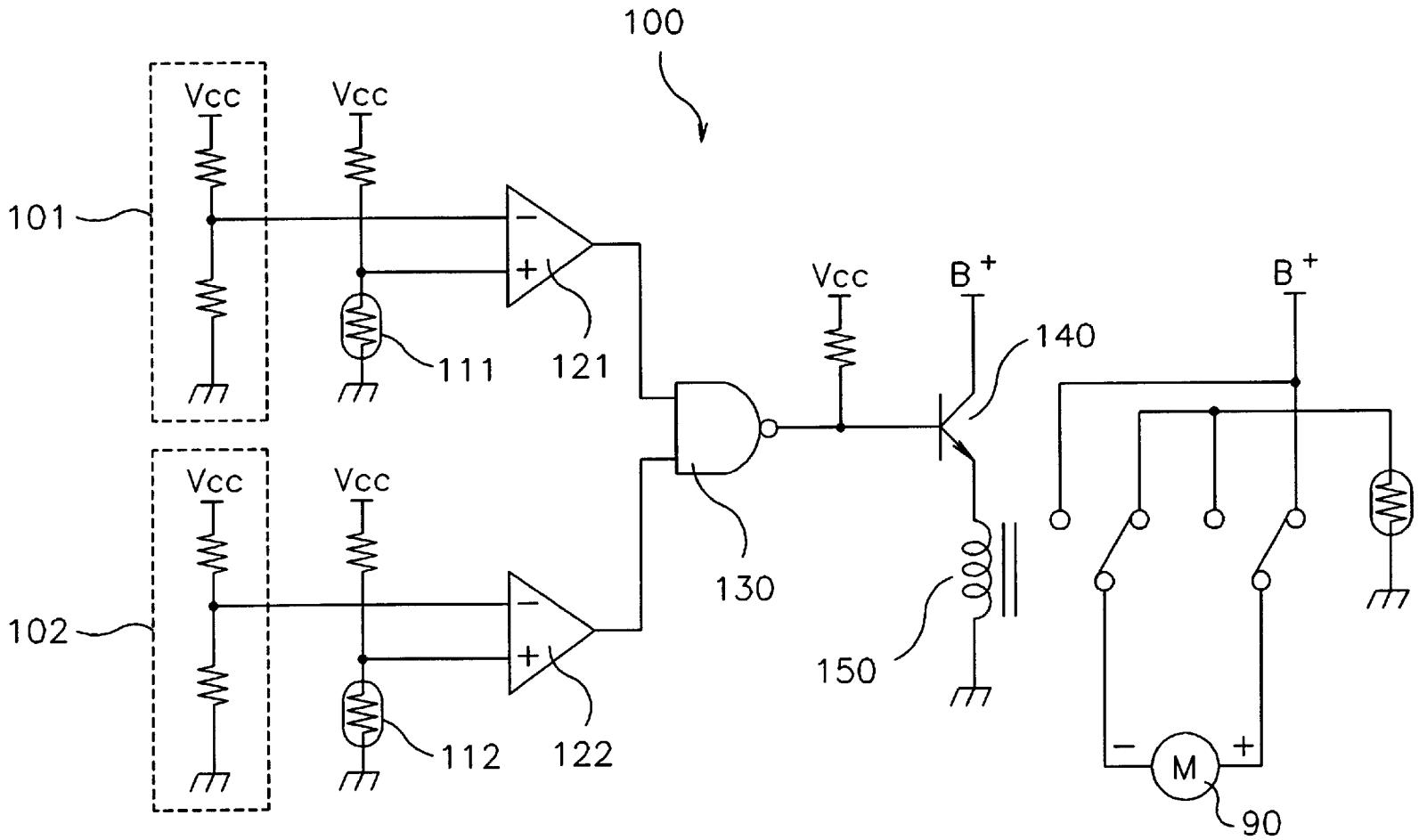
FIG. 4 is a circuit diagram for controlling the refrigerator according to the present invention.

The driving motor 90 is controlled by the control circuit 100 shown in FIG. 4. The control circuit 100 for driving motor comprises a pair of voltage dividers 101, 102, a pair of temperature sensors, a pair of comparators 121, 122, a NAND gate 130, and a switching transistor 140.

The voltage dividers 101, 102 consist of the first voltage divider 101 and the second voltage divider 102. The first voltage divider 101 consists of two resistors R1, R2. When the user sets the cooling intensity of the freezing compartment 61, the ratio of resistors R1, R2 varies, so the first voltage divider 101 outputs a voltage corresponding to the set cooling intensity of the freezing compartment 61. The second voltage divider 102 consists of two resistors R3, R4. When the user sets the cooling intensity of the fresh food compartment 62, the ratio of resistors R3, R4 varies, so the second voltage divider 102 outputs a voltage corresponding to the set cooling intensity of the fresh food compartment 62.

The temperature sensors 111, 112 consist of the first temperature sensor 111 for sensing the temperature in the freezing compartment 61 and the second temperature sensor 112 for sensing the temperature in the fresh food compartment 62. The temperature sensors 111, 112 output the voltages corresponding to the sensed temperatures of the freezing compartment 61 and the fresh food compartment 62 respectively.

The output voltage of the first temperature sensor 111 and the output voltage of the first voltage divider 101 are inputted to the first comparator 121, and the output voltage of the second temperature sensor 112 and the output voltage of the second voltage divider 102 are inputted to the second comparator 122. In that situation, the output voltages of the voltage dividers 101, 102 are inputted into the inverting terminals of the comparators 121, 122 respectively, and the output voltages of the temperature sensors 111, 112 are inputted into the non-inverting terminals of the comparators 121, 122 respectively. Therefore, the first comparator 121 outputs 'HIGH' logic signal when the output voltage of the first temperature sensor 11 is higher than that of the first voltage divider 101, and the second comparator 122 outputs 'HIGH' logic signal when the output voltage of the second temperature sensor 12 is higher than that of the second voltage divider 102.

The outputs of the comparators 121, 122 are inputted into the NAND gate 130. The NAND gate 130 outputs 'LOW' logic signal only when both outputs of the first and the second comparators 121, 122 are 'HIGH', and outputs 'HIGH' if at least one of the outputs of the first and the second comparators 121, 122 are 'LOW'. Thus, the output of the NAND gate 130 is 'LOW' only when the temperatures of the freezing compartment 61 and the fresh food compartment 62 are higher than temperatures corresponding to the set cooling intensities.

The output of the NAND gate 130 is inputted to the switching transistor 140. The switching transistor 140 converts a relay 150 into 'ON' state only when the input thereof is 'LOW'. When the relay 150 is converted to 'ON', the switching state of the power supplied to the driving motor 90 is converted, and accordingly the driving motor 90 drives the plate 75 to pivot. In the 'OFF' state of the relay 150, the freezing compartment duct 71 is closed by the plate 75, and the fresh food compartment duct 72 stays open. Accordingly, only when the relay 150 is converted to 'ON' state, that is, only when both temperatures of the freezing compartment 61 and the fresh food compartment 62 are higher than the temperatures corresponding to the set cooling intensity thereof, the freezing compartment duct 71 is opened and the cool air is supplied into the freezing compartment 61. Since the fresh food compartment 62 is used more frequently than the freezing compartment 61, the loss of cool air according to the frequent opening/closing of the door of the fresh food compartment 62 is great, and since the fresh food compartment 62 is more voluminous than the freezing compartment 61, the fresh food compartment 62 requires a greater amount of cool air. According to the present invention, since the fresh food compartment duct 72 stays in a normal open state, a decline in the cooling intensity of the fresh food compartment 72 due to the frequent use thereof is prevented. Furthermore, since the fresh food compartment duct 72 remains open a little by the protrusion 85 in the closed state of the fresh food compartment 72, the cool air is supplied into the fresh food compartment 62 little and little.

As described above, according to the present invention, it is possible to distribute cool air effectively in both the freezing compartment 61 and the fresh food compartment.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator having a body forming a freezing compartment and a fresh food compartment partitioned from each other, and a cooler for generating cool air supplied into said freezing compartment and said fresh food compartment, said refrigerator comprising:

a freezing compartment duct communicating said cooler with said freezing compartment;

a fresh food compartment duct for communicating said cooler with said freezing compartment;

a fan for blowing the cool air generated from said cooler into said freezing compartment duct and said fresh food compartment duct;

a plate being pivotably installed on an area adjacent to suction ports of said freezing compartment duct and said fresh food compartment duct which are opened near said cooler, said plate for opening/closing the suction ports according to pivoting positions thereof;

a motor for driving said plate; and a control part for controlling said driving motors;

wherein said control part controls said driving motor so that said fresh food compartment duct is in a normal open state.

2. The refrigerator as claimed in claim 1, wherein said control part comprises, first and second temperature sensors for sensing temperatures in said freezing compartment and said fresh food compartment respectively;

first and second comparators for comparing output voltages of said first and second temperature sensors respectively with voltages corresponding to set cooling intensities of said freezing compartment and said fresh food compartment, wherein said comparators output logic signals corresponding to results of comparisons respectively;

a logic gate for performing logic operation of outputs of said first and second comparators; and a motor control circuit part for driving said driving motor in forward and reverse directions according to the outputs of said logic gate.

* * * * *